US006987525B2

(12) United States Patent
Choi

(10) Patent No.: US 6,987,525 B2
(45) Date of Patent: Jan. 17, 2006

(54) IMAGE FORMING APPARATUS FOR DUPLEX PRINTING

(75) Inventor: Dong-ha Choi, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 159 days.

(21) Appl. No.: 10/393,244

(22) Filed: Mar. 21, 2003

(65) Prior Publication Data

US 2003/0209852 A1 Nov. 13, 2003

(30) Foreign Application Priority Data

May 9, 2002 (KR) ..... 2002-25671

(51) Int. Cl.
*B41J 2/435* (2006.01)

(52) U.S. Cl. ..... 347/262; 347/264

(58) Field of Classification Search ..... 347/262, 347/263, 264, 170, 215, 139; 399/364, 381, 399/397, 400, 407; 271/3.19, 6, 9.04, 42, 271/193, 225; 198/310

See application file for complete search history.

(56) References Cited

U.S. PATENT DOCUMENTS 5,448,348 A * 9/1995 Azeta ..... 399/364
6,070,049 A * 5/2000 Hayashida ..... 399/400
6,112,047 A * 8/2000 Kato et al. ..... 399/381
6,233,427 B1 * 5/2001 Hirota et al. ..... 399/407

* cited by examiner

*Primary Examiner*—Hai Pham
(74) *Attorney, Agent, or Firm*—Staas & Halsey LLP

(57) ABSTRACT

An image forming apparatus for duplex printing has a duplex printing unit conveying the paper sheet, which is printed on a first side by a developing unit and a fixing unit on a first paper conveyance path and then conveyed to the paper discharge unit, to be fed back to the developing unit through the fixing unit to form another image on a non-printed side of the paper sheet. The duplex printing unit includes an auxiliary conveyance guide disposed on a surface of the paper conveyance guide to define a second paper conveyance path with the surface of the paper conveyance guide, the second paper conveyance path for conveying the paper sheet printed on the first side and conveyed to the paper discharging unit to be fed back to the developing unit in a reversed posture, a reverse conveying roller assembly disposed between the surface of the paper conveyance guide and the auxiliary conveyance guide to convey the paper sheet through the second paper conveyance path, and a paper conveying portion formed at a point where the first paper conveyance path and the second paper conveyance path meet, to convey the paper sheet picked up by the pickup unit and the paper sheet conveyed through the reverse roller assembly to the first paper conveyance path. Accordingly, the image forming apparatus for duplex printing can have a paper conveyance path with a reduced number of parts as well as a simpler structure.

45 Claims, 10 Drawing Sheets

IMAGE FORMING APPARATUS FOR DUPLEX PRINTING

CROSS-REFERENCE TO RELATED APPLICATIONS

This application claims the benefit of Korean Patent Application No. 2002-25671, filed May 9, 2002, in the Korean Intellectual Property Office, the disclosure of which is incorporated herein by reference.

BACKGROUND OF THE INVENTION

1. Field of the Invention

The present invention generally relates to an image forming apparatus, such as a laser printer or a copier, and more particularly, to an image forming apparatus for duplex printing having a paper conveyance guide using both surfaces thereof as paper feeding surfaces.

2. Description of the Related Art

Generally, an image forming apparatus for printing on both sides of a paper sheet (duplex printing), for example, a laser printer 1, includes a paper feeding cassette 10 having a stack of paper sheets 15 therein, a pickup roller 20 mounted on an upper side of the paper feeding cassette 10 to pick up the paper sheet 15, a paper conveyance guide 22 defining a first paper conveying path that guides the paper sheet 15 picked up by the pickup roller 20, a developing unit 30 that develops a visible toner image on a first side of the paper sheet 15 being conveyed through the paper conveyance guide 22, a fixing unit that fixes the toner image on the first side of the paper sheet 15 passing through the developing unit 30, a conveying roller 50 that conveys the paper sheet 15 that has passed through the fixing unit, a discharge roller 60 arranged on an upper side of the conveying roller 50 to discharge the paper sheet 15, a reverse paper conveyance guide 62 defining a second paper conveying path that guides the paper sheet 15, which is discharged through the discharge roller 60, to re-enter the paper conveyance guide 22 for the duplex printing so as to have a second side of the paper sheet 15 printed, and a first and a second reverse conveying rollers 70 and 90 that reverse-convey the paper sheet 15 through the reverse paper conveyance guide 62*a* as shown in FIG. 1.

The developing unit 30 includes a photosensitive drum 32 that receives light signals, such as a laser beam, from a laser scanning unit (LSU) 36 in accordance with an image signal, thereby forming an electrostatic latent image thereon, and a developing roller (not shown) that attaches toner particles onto the electrostatic latent image of the photosensitive drum 32, thereby forming the toner image.

A transfer roller 34 is disposed below the photosensitive drum 32 of the developing unit 30 to transfer the toner image from the photosensitive drum 32 to the paper sheet 15.

The fixing unit includes a heating roller 41 and a fixing roller 40 fixing the toner image on the paper sheet 15 with heat and pressure.

Formed between the paper conveyance guide 22 and the paper reverse conveyance guide 62, at which the discharging roller 60 is disposed, is a paper reverse guide 42 guiding the paper sheet 15 to the paper reverse conveyance guide 62. The paper reverse guide 42 is formed as an upright arm flexibly hinged between the conveyance guide 22 and the paper reverse conveyance guide 62. On the paper reverse guide 42 is formed a paper sensor (not shown) that senses the paper sheet 15 being conveyed.

The duplex printing by the laser printer 1 constructed as above will be described below.

First, each paper sheet 15 is picked up by the pickup roller 20 from the paper stack of the paper feeding cassette 10, and then conveyed to the developing unit 30 along the paper conveyance guide 22.

By a laser beam emitted from the LSU 36 in accordance with the image signal, the electrostatic latent image is formed on the photosensitive drum 32 of the developing unit 30, and the electrostatic latent image formed on the photosensitive drum 32 is developed into the toner image by the developing roller that attaches the toner particles onto the electrostatic latent image.

The toner image formed on the photosensitive drum 32 is transferred onto the first side, e.g., an upper side, of the paper sheet 15 while the paper sheet 15 is conveyed to the developing unit 30 along the paper conveyance guide 22, and then fixed on the upper side of the paper sheet 15 by the heating roller 41 and the fixing roller 40 of the fixing unit.

After passing through the heating roller 41 and the fixing roller 40, the paper sheet 15 is advanced to the discharging roller 60 by the conveying roller 50. By a rotational force of the conveying roller 50, the paper sheet 15 pushes the paper reverse guide 42 from a dotted line position to a solid line position of FIG. 1. Accordingly, the paper sensor detects that the paper sheet 15 is passing forward the discharging roller 60.

When the printing is performed on the first side of the paper sheet 15 only, i.e., when it is simplex printing, the paper sheet 15 is released onto a paper panel 59 via the discharging roller 60.

In the duplex printing, however, the discharging roller 60 is reverse-driven by a separate forward/reverse rotation control unit (not shown) in accordance with a signal or signals from the paper sensor which generates the signal after a rear tip end of the paper sheet 15 passes through the paper reverse guide 42. As a result, the paper sheet 15 is not released out, but re-entered into the reverse paper conveyance guide 62. Since the paper reverse guide 42 is in the dotted line position, i.e., in an original position due to its recovery force, the paper sheet 15 can be easily re-entered into the reverse paper conveyance guide 62 by the paper reverse guide 42.

When the paper sheet 15 reaches the reverse paper conveyance guide 62, the paper sheet 15 is conveyed to an aligning roller 80 by the first reverse conveying roller 70. The aligning roller 80 is in a tilted posture at an angle about 5°, and thus, a leading tip end of the paper sheet 15 is pushed by the aligning roller 80 into an alignment with the second paper convey path.

After being aligned by the aligning roller 80, the paper sheet 15 is passed through the second reverse conveying roller 90 and conveyed back to the paper conveyance guide 22. Then, after the printing is performed on the second side of the paper sheet 15 in the same way as described above, the paper sheet 15 is released out onto the external paper panel 59.

In the conventional laser printer 1 constructed as above, the paper conveyance guide 22 and the reverse paper conveyance guide 62 are arranged separately from each other. Further, the conventional laser printer 1 requires a number of parts for defining a space for the first and the second paper conveying paths, such as three upper guide plates and four lower guide plates. As a result, a manufacturing cost increases. Further, since an assembling process requires fasteners, such as screws, which are rather complex to assemble, the assembling process takes a lengthy time which deteriorates productivity.

Further, according to the conventional laser printer 1, the first and second paper conveying paths are formed all across the printer 1 in a lengthwise direction. Accordingly, it also takes time in the duplex printing, deteriorating a printing efficiency (both a duplex printing speed and a simplex printing speed). Also, it has a high possibility of having problems, such as a paper jam, a paper skew, or the like.

As the paper conveying path is long, it needs a considerable number of rollers to convey the paper sheet 15 to the paper conveyance guide 22. For example, the reverse paper conveyance guide 62 needs at least three types of rollers, i.e., the first reverse conveying roller 70, the aligning roller 80 and the second reverse conveying roller 90.

Not only are these rollers 70, 80, 90 quite complex to assemble, but the assembling process also requires a number of parts, such as a shaft fixing ring, a power transmitting belt, a pulley for belt, bushing, etc. Accordingly, the assembling process becomes complex, requiring a longer assembling time and a higher cost. Additionally, there is a high possibility of having defects.

More specifically, driving power is transmitted to the first reverse conveying roller 70 and the aligning roller 80 by an idle gear assembly 95 which is employed as a power transmitting unit shown in FIG. 2. The idle gear assembly 95 includes a first idle gear 97*a* rotatably secured to a first boss 96*a* by a first shaft fixing ring 99*a* to be meshed with a gear portion (not shown) formed at an end of a shaft of the first reverse conveying roller 70 while the first boss 96*a* is secured at the reverse paper conveyance guide 62, a second idle gear 97*b* rotatably secured to a second boss 96*b* by a second shaft fixing ring 99*b* to be meshed with the first idle gear 97*a* while the second boss 96*b* is secured at the reverse paper conveyance guide 62, and a third idle gear 97*c* rotatably secured to a third boss 96*c* by a third shaft fixing ring 99*c* to be meshed with the gear portion (not shown) of the aligning roller 80 and the second idle gear 97*b* while the third boss 96*c* is secured at the reverse paper conveyance guide 62.

Since the aligning roller 80 and the second reverse conveying roller 90 are spaced apart from each other by a predetermined distance, as shown in FIG. 3, the driving power needs to be transmitted through a belt pulley 93 secured to a side of the shaft 91 of the second reverse conveying roller 90 by an E-shaped ring 94, a belt pulley (not shown) formed corresponding to the shaft of the aligning roller 80 and a power transmitting belt 93*a* connecting such belt pulleys.

Further, each of the rollers 70, 80, 90 is fabricated through a rather complex process. For example, the second reverse conveying roller 90 has the shaft 91 formed separately from the gear portion and the belt pulley 93, while the roller portion 92 is formed on the shaft 91 by molding.

Further, since the rollers 70, 80, 90 are secured to the reverse paper conveyance guide 62 using the bushings 98, 98', the assembling process requires complicated additional work that takes much longer time.

As a result, the conventional laser printer 1 has the first and second long paper conveying paths for duplex printing, requiring many parts and processes, and thus has the problems of a manufacturing cost increase, printing efficiency deterioration, a frequent paper jam, and productivity deterioration.

SUMMARY OF THE INVENTION

Accordingly, it is an aspect of the present invention to provide an image forming apparatus for duplex printing that uses both opposite faces of a paper conveyance guide as paper conveyance guiding surfaces, thereby shortening a paper conveying path and achieving a high printing process during the duplex printing and a reduction of the number of rollers for the paper conveyance path.

It is another aspect of the present invention to provide an image forming apparatus for duplex printing that provides a plurality of ribs formed on opposite surfaces of the paper conveyance guide, thereby reducing problems, such as a paper jam, a skew, or the like.

It is yet another aspect of the present invention to provide an image forming apparatus for duplex printing that extends a diameter of a conveying roller to feed a paper sheet picked up by a pickup roller to a developing unit, and uses the conveying roller having an extended diameter not only to feed the paper to the developing unit but also to feed the paper to re-enter the developing unit during the duplex printing, thereby achieving a reduction of a paper jam and an improvement in a conveyance efficiency.

It is yet another aspect of the present invention to provide an image forming apparatus for duplex printing that uses components of improved shapes and assembling methods, thereby achieving a reduction of the number of parts and a manufacturing cost, and an improvement of productivity.

Additional aspects and advantages of the invention will be set forth in part in the description which follows and, in part, will be obvious from the description, or may be learned by practice of the invention.

The above and/or other aspects are accomplished by an image forming apparatus for duplex printing according to the present invention, including a paper storing unit mounted in a frame of a body, a pickup unit picking up a paper sheet from a paper stack of the paper storing unit, a developing unit forming a toner image on the paper sheet, a fixing unit fixing the toner image into a visible image on the paper sheet, a paper conveyance guide having a first surface (side) defining a first paper conveyance path that guides the paper sheet to the fixing unit through the developing unit in cooperation with the frame of the body, a paper discharging unit discharging the paper sheet after the visible image is fixed on the paper sheet, and a duplex printing unit conveying the paper sheet conveyed to the paper discharge unit back to the developing unit and the fixing unit to form another image on a non-printed side of the paper sheet. The duplex print unit includes an auxiliary conveyance guide disposed on a second surface (side) of the paper conveyance guide defining a second paper conveyance path in cooperation with the second surface of the paper conveyance guide, the second paper conveyance path formed to guide the paper sheet having a first side printed and conveyed to the paper discharging unit back to the developing unit in a reversed posture, a reverse conveying roller assembly disposed between the second surface of the paper conveyance guide and the auxiliary conveyance guide to convey the paper sheet through the second paper conveyance path, and a paper conveying portion formed at a point where the first paper conveyance path and the second paper conveyance path meet, to convey the paper sheet picked up by the pickup unit and the paper sheet conveyed through the reverse roller assembly to the first paper conveyance path.

According to another aspect of the present invention, the paper conveying guide comprises a plurality of protruding ribs formed on the first and second surfaces at predetermined intervals in a paper advancing direction to enable a paper conveyance to be performed with a reduced friction. Further, the paper conveyance guide includes one or more ground members secured on the first surface of the paper conveyance guide to ground the paper sheet by a fixing portion having one or more protrusions formed either on the corresponding ground members or on the paper conveyance guide, and one or more protrusion receiving holes formed either on the corresponding ground members or on the paper conveyance guide.

The paper conveyance guide further includes one or more main grounds being secured on a side of the paper conveyance guide by a main ground fixing portion to connect the ground members and a transfer member with a printed circuit board of the body, the main ground fixing portion including one or more protrusions formed either on the corresponding main grounds or on the paper conveyance guide, and one or more protrusion receiving holes formed either on the corresponding main grounds or on the paper conveyance guide.

The auxiliary conveyance guide includes a first guide portion disposed on the paper conveyance guide to be extended over the second surface of the paper conveyance guide to define a part of the second paper conveyance path with the frame of the body to selectively restrict the paper sheet conveyed to the paper discharge unit, thereby guiding the paper sheet to enter the second paper conveyance path, a second guide portion disposed on the second surface of the paper conveyance guide, constituting a part of the second paper conveyance path in cooperation with the second surface of the paper conveyance guide, and a third guide portion disposed on the frame of the body to guide the paper sheet to be conveyed through the second guide portion along the second paper conveyance path to the first paper conveyance path defined along the developing unit and the fixing unit.

The first and the second guide portions are secured on a cover which is pivotally mounted on the frame of the body to pivotally open and close the paper conveyance guide.

The reverse conveying roller assembly includes one or more reverse conveying rollers disposed on the second surface of the paper conveyance guide by a fixing member, one or more tension rollers disposed on the second guide portion of the auxiliary conveyance guide to be in contact with the reverse conveying roller with a predetermined pressure, and gear parts disposed on one end of a shaft of the corresponding reverse conveying rollers, to transmit a driving force from a driving motor to the reverse conveying rollers.

Alternatively, the reverse conveying roller assembly includes two reverse conveying rollers formed on the second surface of the paper conveyance guide by the fixing member at a predetermined distance from each other. In this case, an idle gear assembly is formed between the gear parts of the shafts of the two reverse conveying rollers to transmit the driving force in an uniform direction from one reverse conveying roller to the other reverse conveying roller. The idle gear assembly includes a first idle gear rotatably supported on a first boss secured on the paper conveyance guide in an engagement with the gear part of the shaft of one reverse conveying roller, and having a first washer integrally formed either on upper or on lower side thereof, a second idle gear rotatably supported on a second boss secured on the paper conveyance guide in an engagement with the first idle gear, and having a second washer integrally formed either on an upper or on a lower side thereof, and a third idle gear rotatably supported on a third boss secured on the paper conveyance guide in an engagement with the second idle gear and the gear part of the shaft of the other reverse conveying roller, and having a third washer integrally formed either on an upper or on a lower side thereof. The first, the second and the third idle gears are arranged on the first, the second and the third bosses in a manner such that the washers thereof are positioned in an alternate arrangement, enabling a fixing thereof with one idle gear secured on the corresponding boss without having to secure all the idle gears on the corresponding bosses.

The reverse conveying roller includes a plastic shaft having a gear part integrally formed thereon and a roller part of a tubular shape being fit with the shaft.

The fixing member fixing the reverse conveying roller to the paper conveyance guide includes one or more holes formed on the paper conveyance guide, a shaft bushing having a hook formed at one end to be securely inserted in the corresponding holes, and a C-shape opening formed in the other end to securely receive the shaft of each reverse conveying roller.

The duplex printing unit includes a paper side guiding portion disposed on the second surface of the paper conveyance guide to guide an edge of the paper sheet during a paper conveyance by the reverse conveying roller assembly, thereby preventing a paper skew. The side guiding portion includes a rail portion formed on one end having a flattened U-shape to guide the edge of the paper sheet, and a fixing portion formed on the other end to fix the rail portion to the second surface of the paper conveyance guide.

The paper conveying portion includes a conveying roller of a large diameter disposed on the paper conveyance guide in a point where the first paper conveyance path and the second paper conveyance path join, one or more first backup rollers disposed on the frame of the body to define the first paper conveyance path to be in contact with the conveying roller with a predetermined pressure to convey the paper sheet picked up by the pickup unit along the first paper conveyance path, and one or more second backup rollers disposed on the third guide portion of the auxiliary conveyance guide to be in contact with the conveying roller with a predetermined pressure to convey the paper sheet being conveyed through the reverse conveying roller to the first paper conveyance path.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
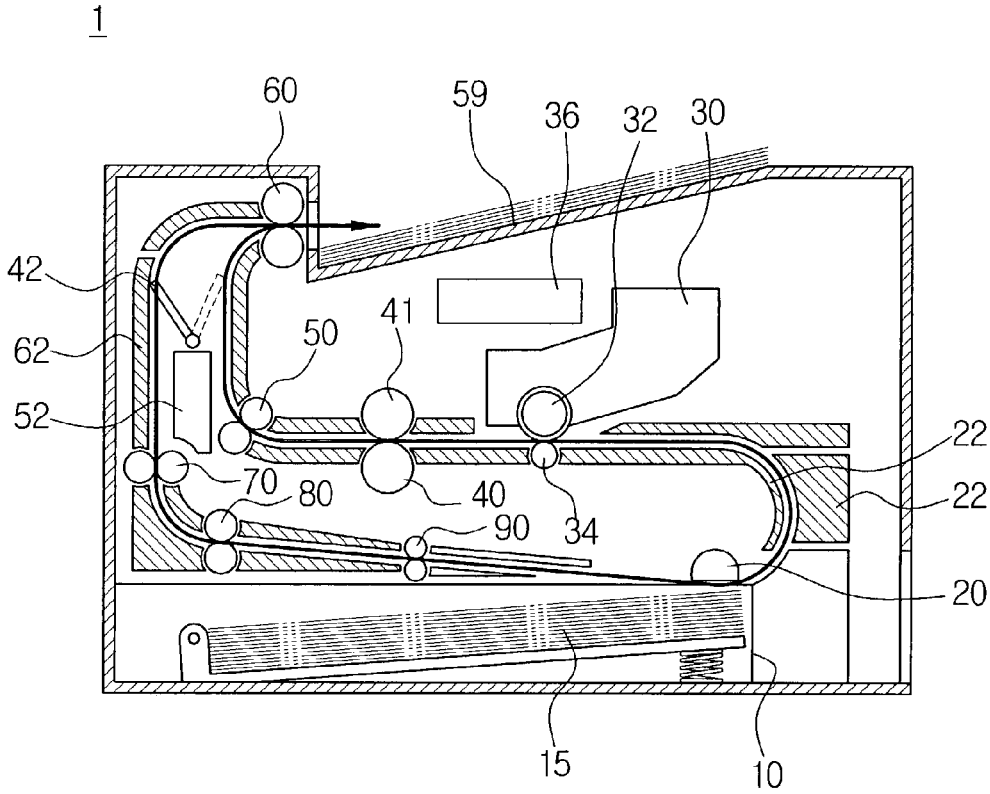
FIG. 1 (PRIOR ART)
FIG. 1 is a sectional view of a conventional laser printer for duplex printing.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinbelow, an image forming apparatus for duplex printing according to an embodiment of the present invention will be described in greater detail with reference to the accompanying drawings.

Figure 4:
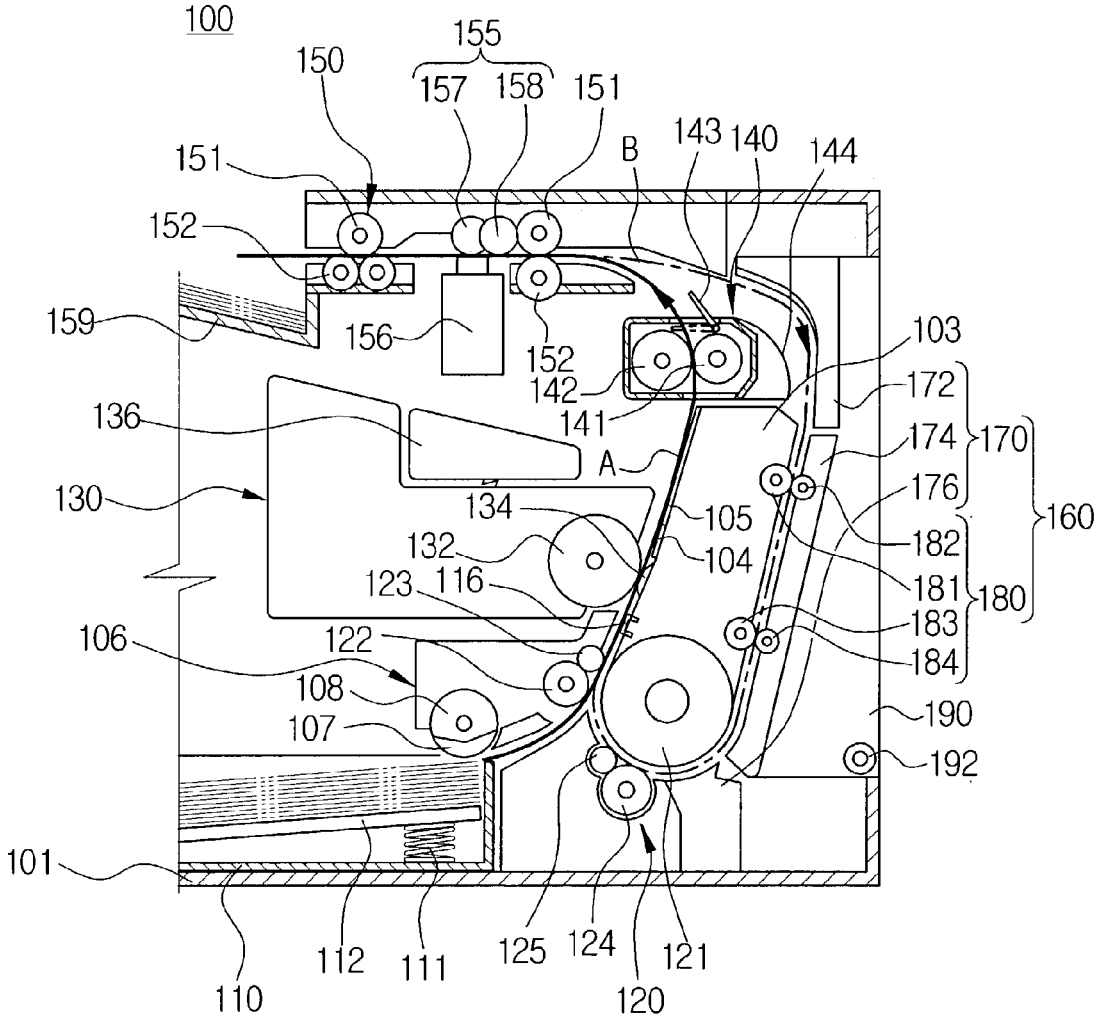
FIG. 4 is a schematic view of a laser printer for duplex printing according to an embodiment of the present invention.

Referring to FIG. 4, a laser printer 100 is schematically illustrated, as one example of the image forming apparatus according to the present invention.

The laser printer 100 includes a paper feeding cassette 110 removably mounted in a frame (not shown) of a body 101, a pickup unit 106 picking up paper sheets from a paper stack in the paper feeding cassette 110, a developing unit 130 developing a toner image on a paper sheet, a fixing unit 140 fixing the toner image on the paper sheet into a visible image by thermal-pressing, a paper conveyance guide 103 having a first surface (side) that defines a first printing paper conveyance path (A) in cooperation with a part of the frame of the body 101 to guide the paper sheet to the fixing unit 140 via the developing unit 130, a paper discharging unit 150 discharging the paper sheet on which the visible toner image is completely fixed by the fixing unit 140, and a duplex printing unit 160 feeding the paper sheet to re-enter the developing unit 130 after the paper sheet is conveyed to the paper discharging unit 150 via the fixing unit 140.

The paper feeding cassette 110 is formed at a lower portion of the body 101, and has a spring 111 that elastically lifts and lowers a paper pressing plate 112 together with the paper sheet on the paper pressing plate 112.

The pickup unit 106 is formed above the paper feeding cassette 110 to sequentially pick up the paper sheets from the paper stack of the paper feeding cassette 110 one sheet each time. The pickup unit 106 includes a pickup roller 107 picking up the paper sheet and a supporting portion 108 rotatably supporting the pickup roller 107. The pickup roller 107 is connected to an output side of a driving motor (not shown) via a belt or gear (not shown).

The developing unit 130 is removably mounted in the frame of the body 101 to be disposed above the pickup unit 106. The developing unit 130 includes a photosensitive drum 132 forming an electrostatic latent image thereon by a laser beam that is emitted from a laser scanning unit (LSU) 136 in accordance the image signal as received, a charging roller (not shown) charging the photosensitive drum 132 to a predetermined voltage, and a developing roller (not sown) developing the electrostatic latent image on the photosensitive drum 132 into the toner image by attaching toner particles onto the electrostatic latent image.

Figure 5:
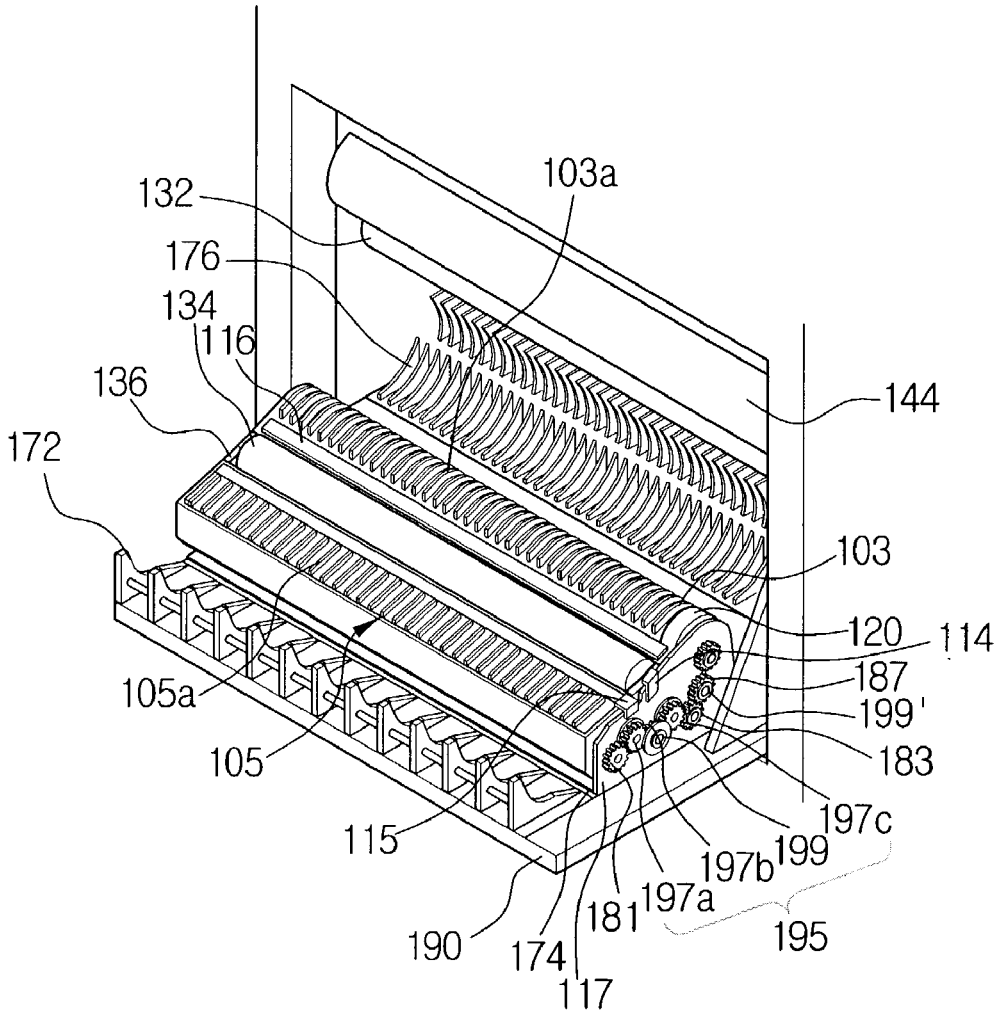
FIG. 5 is a partial perspective view showing a cover of the laser printer of FIG. 4.
Figure 6:
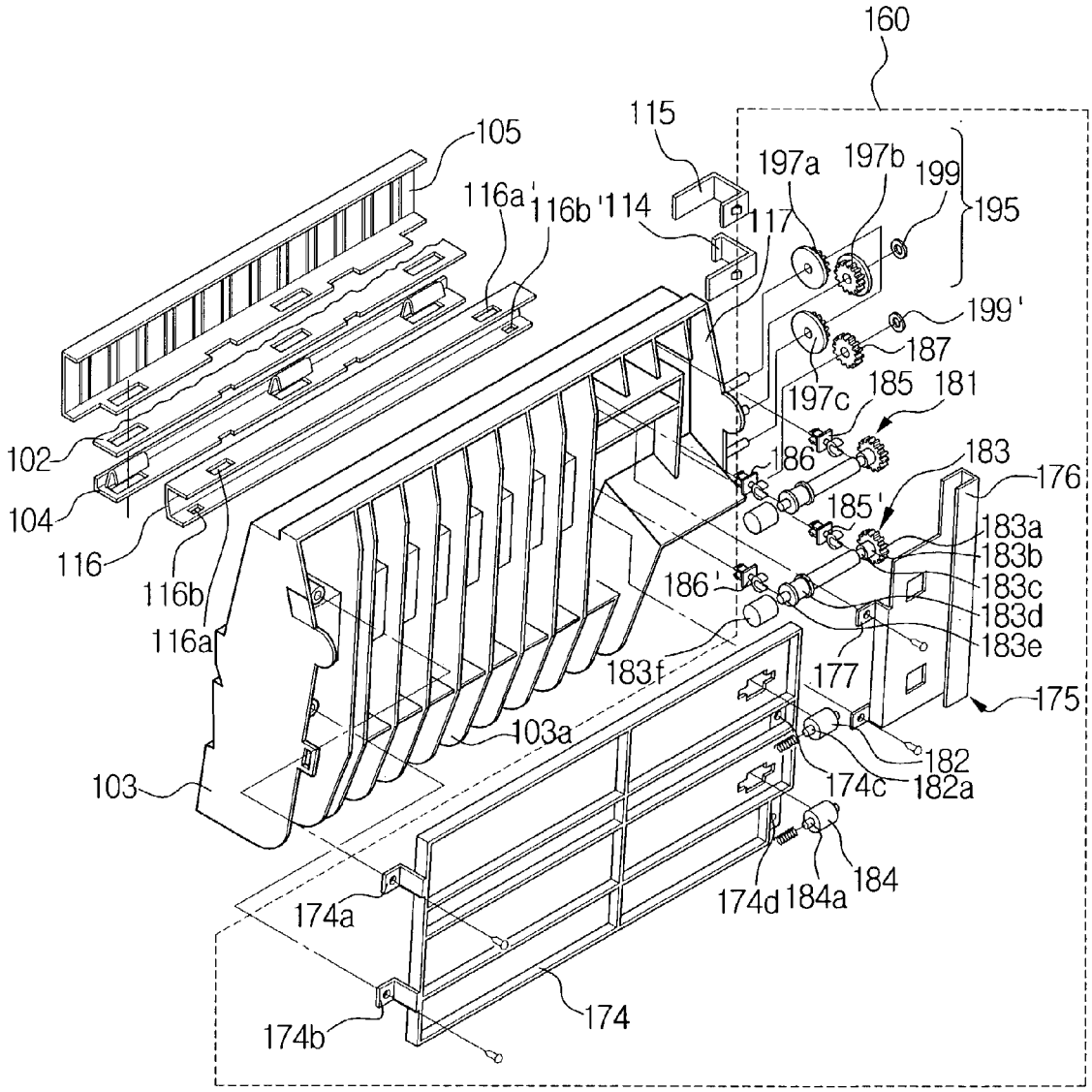
FIG. 6 is an exploded perspective view of a paper conveyance guide and a duplex printing unit of the laser printer of FIG. 4.

As shown in FIGS. 5 and 6, disposed in turn at the first surface of the paper conveyance guide 103 defining the first paper conveyance path (A) are a front ground portion 116 removing static elasticity from the paper sheet, a transfer roller 134 transferring the toner image of the photosensitive drum 132 onto the paper sheet, and a rear ground portion 105 grounding the paper sheet passing through the transfer roller 134.

The front ground portion 116 is formed as an elongated bar of a flattened U-shape having a plane surface thereon to increase a contact area with the paper sheet, and connected to a printed circuit board (not shown) of the body 101 via a front main ground (not shown).

Figure 9:
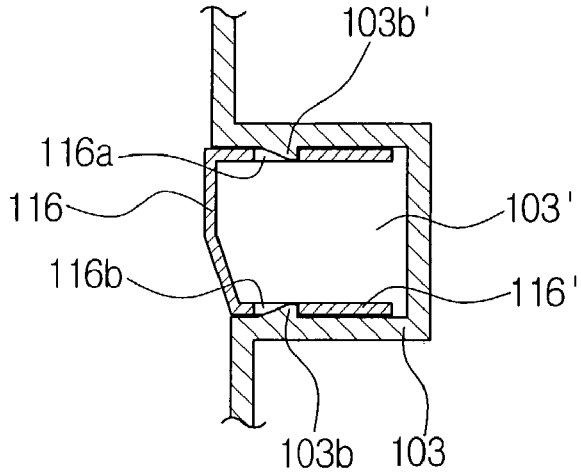
FIG. 9 is a cross-sectional view of a front ground portion being engaged with the paper conveyance guide of the laser printer of FIG. 4.

Further, as shown in FIG. 9, the front ground portion 116 is snap-fit in a first accommodating recess (portion) 103' formed on the first surface of the paper conveyance guide 103 by front ground portion fixing members 103*b*, 103*b*', 116*a*, 116*b*.

The front ground portion fixing members 103*b*, 103*b*', 116*a*, 116*b* include a plurality of protrusions 103*b*, 103*b*' formed on a sidewall of the first accommodating portion 103' at predetermined intervals, and protrusion accommodating holes 116*a*, 116*b*, 116*a*', 116*b*' (FIG. 6) formed in both sides 116' of the front ground portion 116 at predetermined intervals to correspond to the protrusions 103*b*, 103*b*'.

Figure 10:
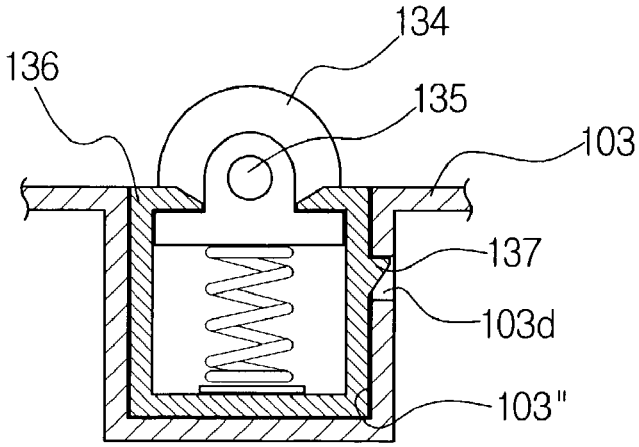
FIG. 10 is a cross-sectional view of a transfer roller and a transfer roller holder being engaged with the paper conveyance guide of the laser printer of FIG. 4.

As shown in FIG. 10, the transfer roller 134 connected to the printed circuit board of the body 101 via a transfer roller main ground 114 is fixed by inserting protrusions 137 formed on an outer surface of a sidewall of a general holder 136 that supports both sides of shaft 135 by a spring, into accommodating holes 103*d* formed on a second accommodating portion 103" formed on the the first surface of the paper conveyance guide 103.

The rear ground portion 105 includes a plurality of ribs 105*a* (FIG. 5) formed on a side in an advancing direction at predetermined intervals, a serrated bracket 102 (FIG. 6) connecting the ribs 105*a*, a holder bracket 104 holding the serrated bracket 102, and a rear main ground 115 connecting the holder bracket 104 to the printed circuit board.

Figure 11:
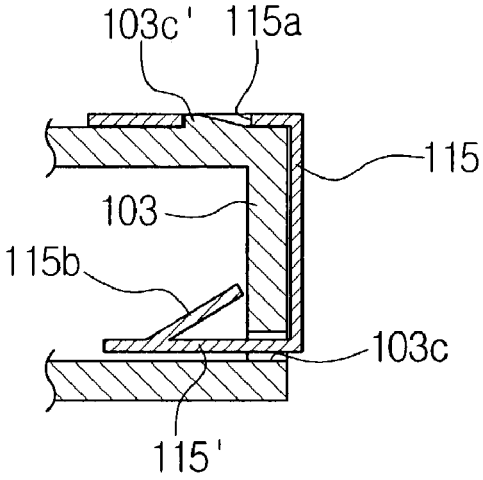
FIG. 11 is a cross-sectional view of a main ground being engaged with the paper conveyance guide of the laser printer of FIG. 4.

The front main ground connected with one end of the front ground portion 116, the transfer roller main ground 114 connected with one end of the shaft 135 of the transfer roller 134, and the rear main ground 115 connected with one end of the rear ground portion 105 are secured at a side of the paper conveyance guide 103 by main ground fixing members. For example, as shown in FIG. 11, the rear main ground 115 is secured to the side adjacent to the first surface of the paper conveyance guide 103 by main ground fixing members 103*c*', 103*c*, 115*a*, 115*b*. The main ground fixing members 103*c*', 103*c*, 115*a*, 115*b* include protrusions 103*c*' protruding from the first surface of the paper conveyance guide 103, an accommodating hole 103*c* formed on a side of the paper conveyance guide 103, and another accommodating hole 115*a* and another protrusion 115*b* formed on one end of the two sidewalls 115' of the rear main ground 115.

As described above, the front and rear ground portions 116, 105, the transfer roller and rear main grounds 114, 115 are secured to the paper conveyance guide 103 by snap-fitting instead of using fasteners, such as screws, which are complex to assemble and take a longer time. As a result, an assembling process becomes easier, an assembling time is reduced, and productivity increases.

On a remaining portion of the first surface of the paper conveyance guide 103, i.e., on a place where the front and rear ground portions 116, 105 and the transfer roller 134 are not arranged, a plurality of protruding ribs 103*a* (FIG. 5) are formed in the paper advancing direction at uniform intervals in order to prevent friction with the paper sheet. Due to the presence of the protruding ribs 103*a*, an area subject to the friction with the paper sheet decreases, and as a result, a possibility of having a paper jam is reduced.

Referring back to FIG. 4, the fixing unit 140 pressing and thereby fixing the toner image from the photosensitive drum 132 on the paper sheet includes a pressing roller 142 and a heating roller 141. As will be described in greater detail below, a paper sensor 143 is disposed downstream of the first paper conveying path (A) of the fixing unit 140 to detect a passage of the paper sheet and subsequently outputs a paper detection signal to the control unit (not shown) that controls the paper discharging and duplex printing.

The paper sensor 143 includes a pivot lever supported on a pivot axis and connected to, namely, a limit switch or a solenoid, so as to pivot by a contact with the paper sheet. Upon sensing a position of the conveyed paper sheet by the contact of the pivot lever with the paper sheet, the paper sensor 143 outputs the paper detection signal to the control unit that will accordingly control either the paper discharging or a reverse paper conveyance to the second paper conveyance path (B).

During a printing process of the laser printer 100 according to the present invention, the paper sensor 143 can be disposed at proper locations in addition to the downstream of the first paper conveyance path (A), such as a certain position between the pickup roller 107 of the pickup unit 106 and a conveying roller 121 of a paper conveying unit 120 which will be described later, another certain position between one of paper discharging rollers 151 of the paper discharging unit 150 and a first reverse conveying roller 181 of a reverse conveying roller assembly 180 which will be described later, and another certain position between the conveying roller 121 and a second reverse conveying roller 183 of a second reverse conveying roller assembly 180. Therefore, according to the paper detection signal indicating that the paper sensor 143 contacts the paper sheet, the control unit can sequentially control the paper sheet along the first and the second paper conveyance paths A, B.

In order to discharge the paper sheet to an external paper panel 159 after fixing the toner image on the paper sheet by the fixing unit 140, the paper discharging unit 150 includes the paper discharging rollers 151 and backup rollers 152 formed correspondingly with each other. The paper discharging unit 150 not only discharges the paper sheets to the external paper panel 159, but also reverses the paper sheet by a driving force of the paper discharging rollers 151 being rotated in forward and reverse directions by the control unit in accordance with the paper signals detection signal from the paper sensor 143.

The duplex printing unit 160 includes a forward/reverse rotation controlling member 155 rotating another one of the paper discharging rollers 151 in alternate directions in accordance with a printing mode and in association with the paper discharging unit 150. The forward/reverse rotation controlling member 155 generally includes a driving power transmitting gear portion 158 having a forward driving gear train (not shown) driving the paper discharging rollers 151 in a forward direction, and a reverse driving gear train (not shown) driving the paper discharging rollers 151 in a reverse direction, a swing gear train 157 shifting engagement between the forward driving gear train and the reverse driving gear train of the driving force transmitting gear portion 158, and a solenoid portion (motor) 156 operating the swing gear train 157.

A general paper reversing guide (not shown) can be movably arranged on the first paper conveyance path A in proximity of the fixing unit 140 to block the paper from being conveyed back into the paper conveyance path A, thereby pivoting to selectively guide the discharging direction of the paper sheet in the forward and reverse directions. The paper reversing guide can include a plurality of protrusions formed at uniform intervals on a single rotary shaft that is disposed along a width of the single rotary shaft, guiding a leading end of the paper sheet to a direction as desired. Alternatively, the paper reversing guide can be formed to be moved in the same way as the conventional paper reversing guide, i.e., it can be formed to be moved in linkage with the paper sensor 143 disposed in the proximity of the fixing unit 140.

The duplex printing unit 160 further includes an auxiliary conveyance guide 170 formed to face a second surface (side) of the paper conveyance guide 103 to define the second paper conveyance path B with the second surface of the paper conveyance guide 103. The paper sheet is fed from the paper discharging unit 150 back to the developing unit 130 second surface of the paper conveyance guide 103 through the second paper conveyance path B. The reverse conveying roller assembly 180 is disposed between the second surface of the paper conveyance guide 103 and the auxiliary conveyance guide 170 to convey the paper sheet along the second paper conveyance path B. The paper conveying unit 120 is formed at a location where the first and the second paper conveyance paths A, B meet, to convey the paper sheet being conveyed through the reverse conveying roller assembly 180 as well as the paper sheet picked up by the pickup unit 106, to the first paper conveyance path A.

The auxiliary conveyance guide 170 includes a first guide portion 172 disposed on the body 101 to be extended above the second surface of the paper conveyance guide 103 and to face a curved rib guide 144 that is fixed on the frame of the body 101 in the proximity of the fixing unit 140, to selectively restrict the paper sheet reaching the paper discharging unit 150, thereby guiding the paper sheet to enter into the second paper conveyance path B, a second guide portion 174 screw-engaged with fixing bosses 174*a*', 174*b*', 174*c*', 174*d*' (FIG. 7) through fixing brackets 174*a*, 174*b*, 174*c*, 174*d* (FIG. 6) that are formed on the second surface of the paper conveyance guide 103 to define a part of the second paper conveyance path B in cooperation with the second surface of the paper conveyance guide 103, and a third guide portion 176 formed on the frame of the body 101 to guide the paper sheet, which is conveyed onto the second paper conveyance path B through the second guide portion 174, to enter the first paper conveyance path A. Together with the paper conveyance guide 103, the first and the second guide portions 172, 174 are securely supported on a cover 190 that is movably mounted on the frame of the body 101 to be pivotally opened and closed about a hinge 192.

Figure 12A:
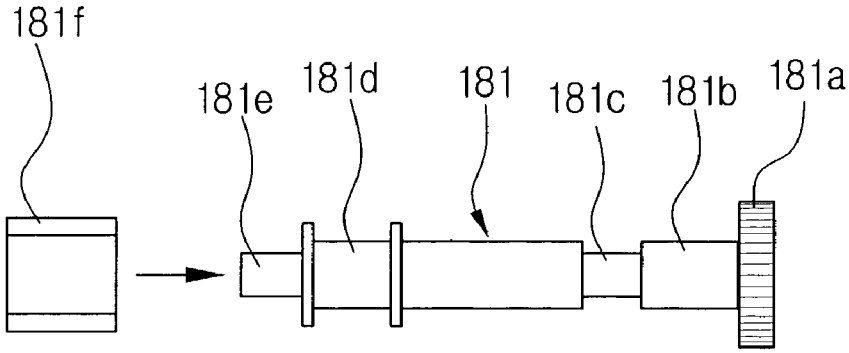
FIGS. 12A and 12B are side views showing a reverse conveying roller and fixing members of the duplex printing unit of the laser printer of FIGS. 4 and 6, respectively.
Figure 12B:
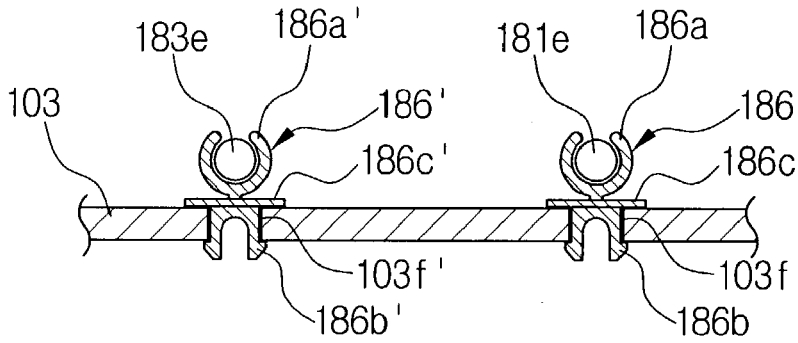

As shown in FIGS. 6, 12A and 12B, the reverse conveying roller assembly 180 includes the first and second reverse conveying rollers 181, 183 rotatably secured on the second surface of the paper conveyance guide 103 by fixing parts 103*f*, 103*f*', 185, 186, 185', 186', two tension rollers 182, 184 disposed on the second guide portion 174 of the auxiliary conveyance guide 170 to be meshed with the reverse conveying rollers 181, 183 with a predetermined pressure, and gear parts 181*a*, 183*a* disposed at certain ends of shafts 181*b*, 183*b* of the first and second reverse conveying rollers 181, 183 to transmit a driving force of a driving motor (not shown) to the first and second reverse conveying rollers 181, 183.

Figure 13:
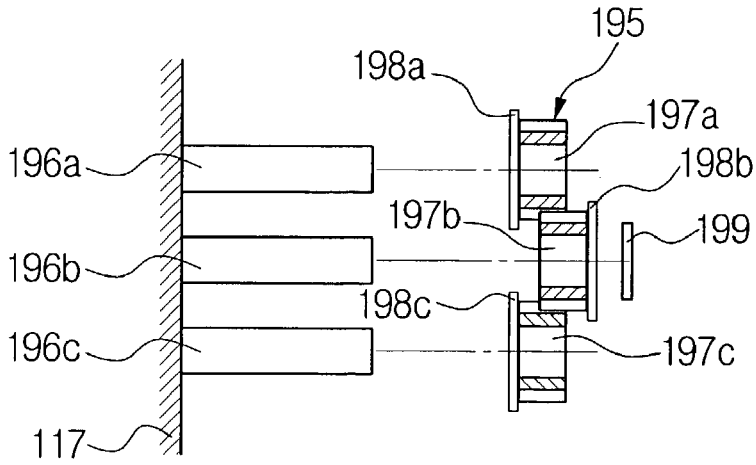
FIG. 13 is a side view of an idle gear assembly transmitting a driving power among reverse conveying rollers of the duplex printing unit of the laser printer of FIGS. 4 and 6.

As shown in FIGS. 5, 6, and 13, an idle gear assembly 195 is disposed between the gear parts 181*a*, 183*a* of the shafts 181*b*, 183*b* of the first and second reverse conveying rollers 181, 183 to transmit the driving force in the uniform direction from the second reverse conveying roller 183 to the first reverse conveying roller 181. The idle gear assembly 195 includes a first idle gear 197*a* rotatably supported on a first boss 196*a* that is secured at a fixing bracket 117 of the paper conveyance guide 103, to be in mesh with the gear part 183*a* of the shaft 183*b* of the second reverse conveying roller 183, and having a first washer 198*a* integrally formed at an upper or lower side of the first idle gear, a second idle gear 197*b* rotatably supported on a second boss 196*b* that is secured at the fixing bracket 117 of the paper conveyance guide 103, to be in mesh with the first idle gear 197*a*, and having a second washer 198*b* integrally formed at an upper or lower side of the second idle gear, and a third idle gear 197*c* rotatably supported on a third boss 196*a* that is secured at the fixing bracket 117 of the paper conveyance guide 103, to be in mesh with the second idle gear 197*b* and the gear part 181*a* of the shaft 181*b* of the first reverse conveying roller 181, and having a third washer 198*c* integrally formed at an upper or lower side. The first, second and third idle gears 197*a*, 197*b*, 197*c* having washers 198*a*, 198*b*, 198*c* integrally formed on an upper or a lower side thereof, are arranged on the fixing bosses 196*a*, 196*b*, 196*c*, respectively, in a manner such that the washers 198*a*, 198*b*, 198*c* are in an alternate arrangement, and the second idle gear 197*b* alone is secured at the second fixing boss 196*b* by a shaft fixing ring 199.

Figure 3:
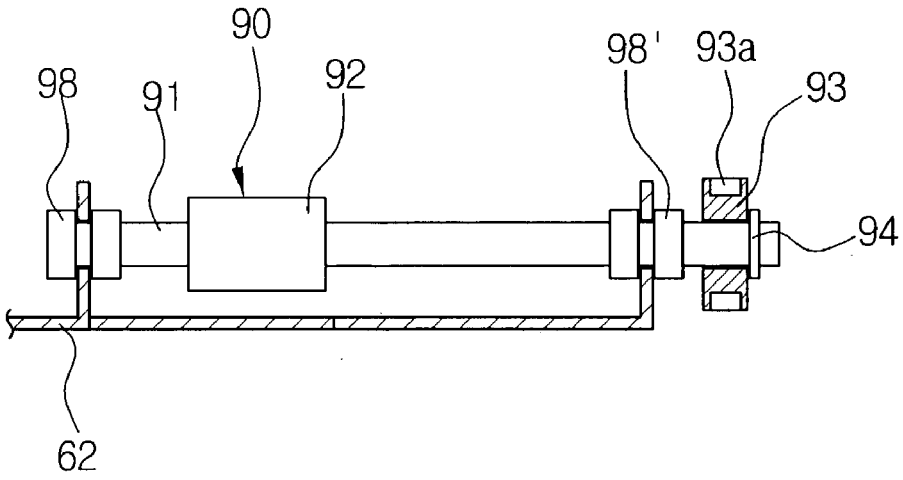
FIG.3 (PRIOR ART)
FIG. 3 is a side view of a reverse conveying roller of the laser printer of FIG. 1.

Further, as shown in FIG. 12A, each of the reverse conveying rollers 181, 183 includes the shaft 181*b* or 183*b* made of plastic and having the gear part 181*a* or 183*a* integrally formed thereon, and a roller part 181*f* or 183*f* of a tubular shape which is fit in fixing groove 181*d* or 183*d*. Unlike a conventional structure that requires a shaft 91 separately from the gear part and a belt pulley 93, and a rubber roller part 92 being formed on the shaft 91 by molding as shown in FIG. 3, a structure of each of the reverse conveying rollers 181, 183 as described above requires no additional assembling work.

Figure 2:
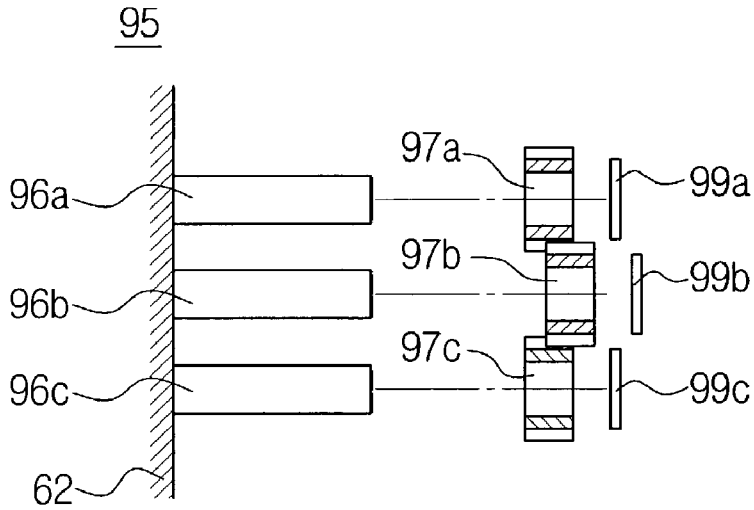
FIG.2 (PRIOR ART)
FIG. 2 is a side view of an idle gear assembly transmitting a driving power among reverse conveying rollers of the laser printer of FIG. 1.

As shown in FIG. 12B, the fixing members 103*f*, 103*f*', 185, 186, 185', 186' fixing the reverse conveyance rollers 181, 183 to the paper conveyance guide 103 include fixing holes 103*f*, 103*f*' formed in the paper conveyance guide 103, and a plurality of shaft bushings 185, 186, 185', 186' having hooks 186*b*, 186*b*' formed at corresponding ends thereof to be inserted in the corresponding fixing holes 103*f*, 103*f*' and C-shape openings 186*a*, 186*a*' formed in another ends thereof to receive and secure accommodating parts 181*e*, 183*e* of the shafts 181*b*, 183*b* of the reverse conveying rollers 181, 183. A linking part 186*c* or 186*c*' is disposed between each hook 186*b* or 186*b*' of the shaft bushings 185, 186, 185', 186' and corresponding C-shape opening 186*a* or 186*a*' to connect the hook 186*b* or 186*b*' and the C-shape opening 186*a* or 186*a*', and supports the corresponding fixing members with respect to the paper conveyance guide 103. As the reverse conveying rollers 181, 183 are fixed on the paper conveyance guide 103 by snap-fitting, which does not require any complicated process and time like conventional fastening members as shown in FIGS. 1–3, the assembling efficiency and the productivity are improved.

Two tension rollers 182, 184 are arranged on rotary shafts 182*a*, 184*a* on the inner side of a second guide portion 174 and at a predetermined distance from each other. The tension rollers 182, 184 elastically bias the reverse conveying rollers 181, 183.

Figure 7:
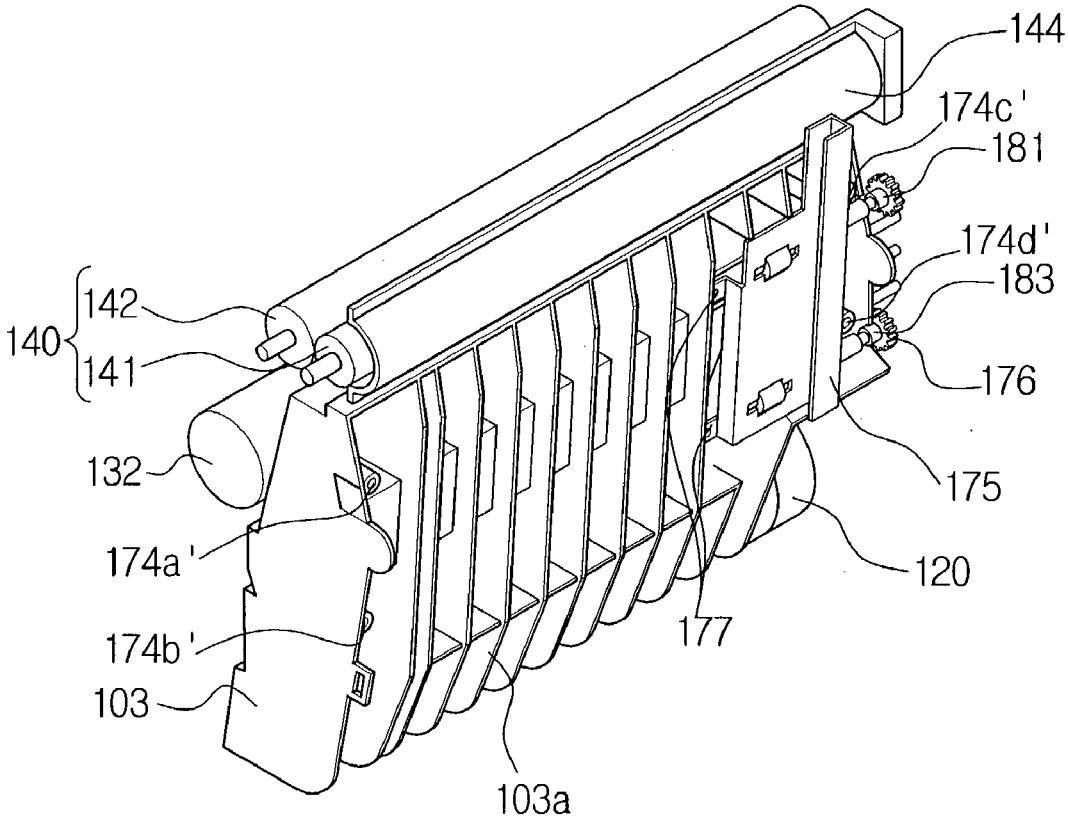
FIG. 7 is a partial perspective view showing a structure at a rear portion of the paper conveyance guide of the duplex printing unit of the laser printer of FIGS. 4 and 6.
Figure 8:
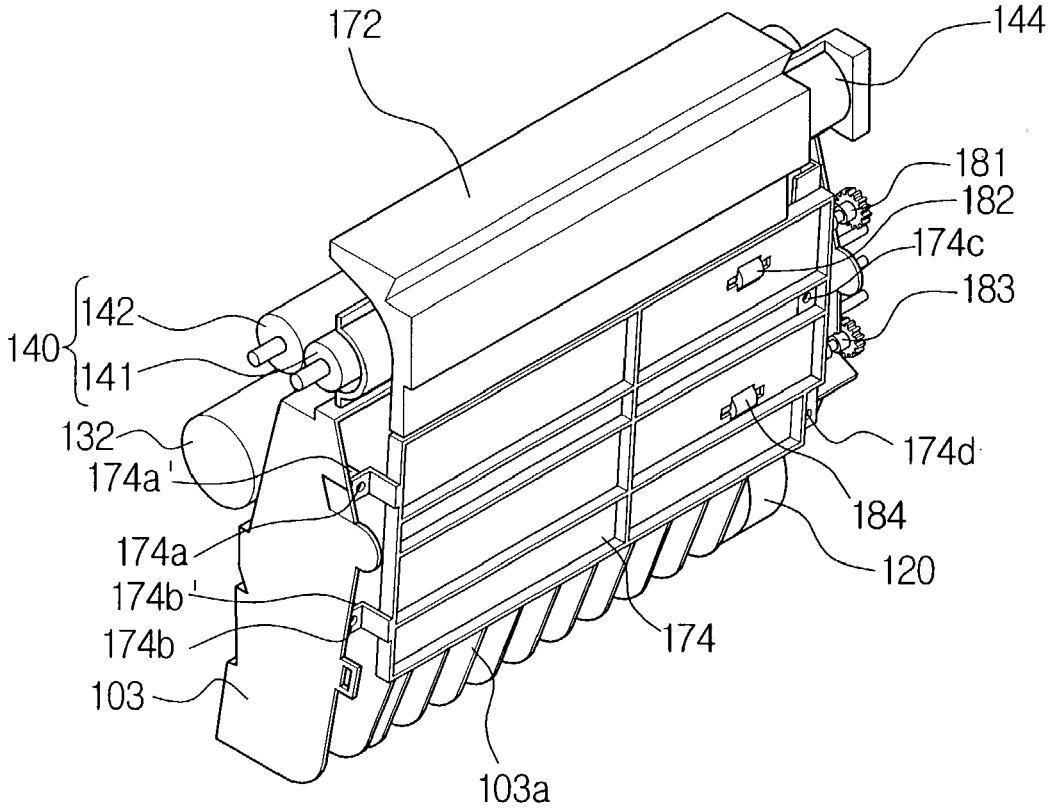
FIG. 8 is a partial perspective view of the paper conveyance guide and the duplex printing unit of the laser printer of FIGS. 4–7.

As shown in FIGS. 6 and 7, a side guide portion 175 is arranged on the second surface of the paper conveyance guide 103 to guide a corner of a certain end of the paper sheet to prevent skewing of the paper sheet during the conveyance of the paper sheet by the reverse conveying roller assembly 180. The side guide portion 175 is formed as a bracket that includes a flattened U-shape rail 176 formed at one end to guide the corner of one end of the paper sheet, and a fixing (coupling) part 177 formed at the other end to fix the side guide portion 175 to the second surface of the paper conveyance guide 103.

Referring back to FIG. 4, the paper conveying portion 120 includes the conveying roller 121 of a large diameter disposed at the paper conveyance guide 103 at a point where the first paper conveyance path A and the second paper conveyance path B meet, a pair of first backup rollers 122, 123 disposed on the frame of the body 101, which defines the first paper conveyance path A, to be in contact with the conveying roller 121 with a predetermined pressure through the paper sheet picked up by the pickup unit 106 to be conveyed along the first paper conveyance path A, a pair of second backup rollers 124, 125 disposed on the third guide portion 176 of the auxiliary conveyance guide 170 to be in contact with the conveying roller 121 with a predetermined pressure to convey the paper sheet conveyed by the reverse conveying roller assembly 180 along the second paper conveyance path B to the first paper conveyance path A.

The conveying roller 121 is in mesh with the first backup rollers 122, 123 to convey the paper sheet picked up by the pickup unit 107 to the developing unit 130, while it is in mesh with the second backup rollers 124, 125 to feed the paper sheet conveyed along the second paper conveyance path B back to the developing unit 130. Accordingly, since a driving power transmitting portion (not shown) is required to be mounted inside of the body 101 to drive only one conveying roller 121, the structure becomes simplified.

Further, since the conveying roller 121 of the large diameter compared to other rollers is disposed at a point where the paper sheet is returned to the first paper conveyance path A from the second paper conveyance path B, a contact area between the conveying roller 121 and the paper sheet increases. As a result, a paper jam is prevented, and paper conveying efficiency increases.

Further, as shown in FIG. 7, the protruding ribs 103*a* are formed at predetermined intervals on the second surface of the paper conveyance guide 103 that defines the second paper conveyance path B, to enable the paper sheet to be conveyed as easily as in the first surface of the paper conveyance guide 103 without having the paper jam.

As described above, both first and second surfaces of the paper conveyance guide 103 are used to define the paper conveyance paths, i.e., the first and the second paper conveyance paths A, B. Accordingly, the paper conveyance path is shortened, which is quite efficient for duplex printing, while the number of the rollers is also reduced. Further, due to the presence of the protruding ribs 103*a* formed on both surfaces of the paper conveyance guide 103, problems like the paper jam and paper skew are prevented.

An operation of the laser printer 100 for the duplex printing constructed as above according to the embodiment of the present invention will be described below with reference to FIGS. 4 through 13.

First, as shown in FIG. 4, with the paper feeding cassette 110 having a paper stack therein and mounted in the body 101, the pickup roller 107 of the pickup unit 106 is rotated to be in tight contact with the paper sheet in accordance with the control of the control unit by the commands from a computer. Accordingly, one sheet is picked up from the paper stack by the pickup roller 107, and conveyed between the conveying roller 121 and the first backup rollers 122, 123.

The paper sheet reaching the conveying roller 121 and the first backup rollers 122, 123 is guided along the first surface of the paper conveyance guide 103 that defines the first paper conveyance path A toward the developing unit 130 by a rotational force of the conveying roller 121 and the first backup rollers 122, 123. In such a situation, as a surface of the front ground portion 116 positioned in front of the developing unit 130 comes in contact with the paper sheet, the static electricity that can influence a toner image transfer process is removed from the paper sheet.

Meanwhile, in accordance with the image signal, the LSU 136 emits the laser beam onto a surface of the photosensitive drum 132 charged by general charging methods, such as a corona discharge, thereby forming the electrostatic latent image on the photosensitive drum 132. After being formed on the photosensitive drum 132, the electrostatic latent image is developed into the visible toner image as the toner particles are attached thereon by the developing roller (not shown) being rotated opposite to the photosensitive drum 132.

Next, as the paper sheet having the static electricity removed by the front ground portion 116 is kept being conveyed by the conveying roller 121 and the first backup rollers 122, 123 and thus passed along the photosensitive drum 132, the toner image on the photosensitive drum 132 is transferred onto the paper sheet by being squeezed between the photosensitive drum 132 with a transfer roller 134 and the high voltage of opposite polarity applied on the transfer roller 134.

Then as the paper sheet reaches at the fixing unit 140, the toner image on the first side of the paper sheet is fixed into a printed image by the heat of the heating roller 142 and the pressure of fixing roller 141.

After the desired image is printed, the paper sheet is moved by the heating roller 142, the fixing roller 141, and so on, and then comes to push the paper sensor 143. Accordingly, the paper sensor 143, which is fixed on the rotary shaft connected to the limit switch or to the solenoid, pivots by the contact with the paper sheet. The paper sensor 143 outputs the paper detection signal to the control unit, and accordingly, the control unit drives the paper discharging rollers 151 of the paper discharging unit 150 to convey the paper sheet toward the external paper panel 159.

In simplex printing, the control unit of the laser printer 100 keeps driving the paper discharging rollers 151 of the paper discharging unit 150 until the paper sheet is released out onto the external paper panel 159.

In the duplex printing, however, the control unit controls so that the paper discharge unit 150 is reverse-rotated after a predetermined time that a rear end of the paper sheet is further moved from the paper sensor 143 by a predetermined distance, thereby shifting an advancing direction of the paper sheet and feeding the paper sheet to re-enter the second paper conveyance path B.

Controlling a reverse-rotation of the paper discharge unit 150 is performed by the forward/reverse rotation control member 155 which is operated in linkage with the discharge unit 150. More specifically, the solenoid portion 156 of the forward/reverse rotation control member 155 is operated to switch the swing gear train 157 to an engagement with the reverse driving gear train of the power transmitting gear portion 150 that rotates the paper discharge rollers 151 in the reverse direction, thereby causing the driving power of the motor (solenoid portion) 156 to be transmitted to the paper discharge rollers 151 in the reverse direction.

During the reverse conveyance of the paper sheet, the paper reversing guide disposed on the first paper conveyance path A in the vicinity of the fixing unit 140 selectively pivots to make the paper sheet that is conveyed in the reverse direction not move into the first paper conveyance path A. As a result, the rear end of the paper sheet is guided to the second paper conveyance path B.

Being guided along the second paper conveyance path B, the paper sheet enters between the first guide portion 172 and the curved-rib guide 144 formed in the proximity of the fixing unit 140 by the rotational force of the another one of paper discharge rollers 151.

As the paper sheet continues to be conveyed and thus reaches a space defined between the protruding ribs 103*a* on the second surface of the paper conveyance guide 103 that defines a part of the second paper conveyance path B with the second guide portion 174, the control unit drives the driving motor (not shown) to drive the reverse conveying rollers 181, 183 in mesh with the tension rollers 182, 184 with a predetermined pressure according to signals from the paper sensor (not shown) disposed in the proximity of the second guide portion 174.

The driving force being transmitted to the second reverse conveying roller 183 via the power transmitting portion (not shown) and a gear portion 187 (FIG. 5), is transmitted by the idle gears 197*a*, 197*b*, 197*c* to the first reverse conveying roller 181 in the form of a rotational force in the same direction, such as, the rotational force in a clockwise direction.

During the conveyance of the paper sheet by the rotational force of the reverse conveying rollers 183, 184, one tip end of the paper sheet is aligned by a side guide portion 175 disposed at one side of the second guide portion 174, and guided by the protruding ribs 103*a* formed on the second surface of the paper conveyance guide 103. Thus, problems, such as the paper skew and the paper jam, do not occur.

Even when the paper jam occurs in the second paper conveyance path B, the cover 190, which is pivotably disposed on the hinge 92 of the frame of the body 101, can pivot to be open, the first and the second guide portions 172, 174 and the paper conveyance guide 103 are easily exposed, and accordingly, the paper jam can be easily dealt with.

As the paper conveyance continues, and accordingly when the paper sheet reaches the paper conveying portion 120, the conveying roller 121 of the paper conveying portion 120 being driven by the power transmitting portion (not shown) of the body 101 comes into contact with the second backup rollers 124, 125 of the third guide portion 176 on the second paper conveyance path B, thereby being driven clockwise. As a result, the paper sheet is reversed along the third guide portion 176, and conveyed toward the first backup rollers 122, 123 that are located on the first paper conveyance path A.

As the paper sheet is conveyed between the first backup rollers 122, 123, the conveying roller 121 feeds the paper sheet to re-enter the developing unit 132 in an engagement with the first backup rollers 122, 123 with a predetermined pressure. After that, the toner image is transferred and fixed on a second side of the paper sheet in the same manner as described above, and then the paper sheet is released out to the external paper panel 159, and the duplex printing is completed.

As described above, the laser printer for duplex printing according to the present invention uses both surfaces (sides) of the paper conveyance guide as the paper conveyance paths, and also are provided with the ribs, thereby shortening the paper conveyance path for duplex printing, increasing duplex printing efficiency, preventing problems, such as the paper jam and paper skew, and reducing the number of the rollers for conveying the paper sheet.

Further, the laser printer according to the present invention is provided with the conveying roller of an enlarged diameter for feeding the paper sheet picked up by the pickup roller to the developing unit, and uses the conveying roller of the enlarged diameter not only for feeding the paper sheet to the developing unit, but also for conveying the paper sheet to be fed back to the developing unit for duplex printing. Accordingly, the paper jam is reduced while the conveying efficiency increases.

Further, the laser printer according to the present invention uses snap-fitting for securing the ground portion, the reverse conveying roller, or the like on the paper conveyance guide instead of fasteners, such as screw or bushing, that require complicated assembling process and time. As a result, the assembling process becomes simpler, the assembling time is shortened, and the productivity increases.

Finally, since the laser printer according to the present invention has a plastic shaft having a gear part integrally formed thereon as a reverse conveying roller, an additional assembling process, such as assembling the gear part to the shaft, is omitted.

Although the preferred embodiment of the present invention has been described, it will be understood by those skilled in the art that the present invention should not be limited to the described preferred embodiment, but various changes and modifications can be made within the spirit and scope of the present invention as defined by the appended claims and their equivalents.

What is claimed is:

1. An image forming apparatus having a frame of a body and a paper storing unit mounted in the frame, comprising:

a pickup unit picking up a paper sheet from a paper stack of the paper storing unit;

a developing unit forming a toner image on the paper sheet;

a fixing unit fixing the toner image into a visible image on the paper sheet;

a paper conveyance guide having a first surface defining a first paper conveyance path that guides the paper sheet to the fixing unit through the developing unit, with the frame of the body;

a paper discharging unit discharging the paper sheet after the visible image is fixed on the paper sheet; and a duplex printing unit conveying the paper sheet conveyed to the paper discharging unit back to the developing unit through the fixing unit to form another image on a non-printed side of the paper sheet, comprising:

an auxiliary conveyance guide disposed on a second surface of the paper conveyance guide to define a second paper conveyance path with the second surface of the paper conveyance guide, the second paper conveyance path being formed to convey the paper sheet having a printed side and conveyed to the paper discharging unit to be fed back to the developing unit in a reversed posture, a reverse conveying roller assembly disposed between the second surface of the paper conveyance guide and the auxiliary conveyance guide to convey the paper sheet through the second paper conveyance path, and a paper conveying portion formed at a point where the first paper conveyance path and the second paper conveyance path meet, to convey the paper sheet picked up by the pickup unit and the paper sheet conveyed through the reverse roller assembly to the first paper conveyance path, wherein the paper conveyance guide comprises a plurality of protruding ribs formed on the first and second surfaces at predetermined intervals in a paper advancing direction to enable a paper conveyance to be performed while reducing a friction, and wherein the paper conveyance guide comprises one or more ground members secured on the first surface of the paper conveyance guide and a fixing portion fixing the ground members on the frame of the body to ground the paper sheet, and the fixing portion comprising one or more protrusions formed either on the ground members or on the paper conveyance guide, and one or more protrusion receiving holes formed either on the ground members or on the paper conveyance guide.

2. The image forming apparatus for duplex printing of claim 1, wherein the body comprises a printed circuit board, the one or more ground members include one or more main grounds, and the paper conveyance guide includes a transfer member and a main ground fixing portion fixing the main grounds on a side thereof and connecting the ground member and the transfer member with a printed circuit board of the body, and the main ground fixing portion comprising one or more protrusions formed either on the main ground or on the paper conveyance guide, and one or more protrusion receiving holes formed either on the main grounds or on the paper conveyance guide.

3. An image forming apparatus having a frame of a body and a paper storing unit for duplex printing, comprising:

a pickup unit picking up a paper sheet from a paper stack of the paper storing unit;

a developing unit forming a toner image on the paper sheet;

a fixing unit fixing the toner image into a visible image on the paper sheet;

a paper conveyance guide having a first surface defining a first paper conveyance path that guides the paper sheet to the fixing unit through the developing unit, with the frame of the body;

a paper discharging unit discharging the paper sheet after the visible image is fixed on the paper sheet; and a duplex printing unit convey the paper sheet conveyed to the paper discharging unit to be fed back to the developing unit through the fixing unit to form another image on a non-printed side of the paper sheet, comprising:

an auxiliary conveyance guide disposed on a second surface of the paper conveyance guide to define a second paper conveyance path with the second of the paper conveyance guide, the second paper conveyance path being formed to convey the paper sheet having a printed side and conveyed to the paper discharging unit to be fed back to the developing unit in a reversed posture, a reverse conveying roller assembly disposed between the second surface of the paper conveyance guide and the auxiliary conveyance guide to convey the paper sheet through the second paper conveyance path, and a paper conveying portion formed at a point where the first paper conveyance path and the second paper conveyance path meet, to convey the paper sheet picked up by the pickup unit and the paper sheet conveyed through the reverse roller assembly to the first paper conveyance path, wherein the auxiliary conveyance guide comprises:

a first guide portion disposed on the paper conveyance guide to be extended over the second surface of the paper conveyance guide, defining a part of the second paper conveyance path with the frame of the body, to selectively restrict the paper sheet conveyed to the paper discharging unit and to guide the paper sheet to enter to the second paper conveyance path;

a second guide portion disposed on the second surface of the paper conveyance guide, constituting a part of the second paper conveyance path with the second surface of the paper conveyance guide; and a third guide portion disposed on the frame of the body to guide the paper sheet to be conveyed through the second guide portion along the second paper conveyance path, to the first paper conveyance path defined along the developing unit and the fixing unit, and wherein the body comprises a cover pivotally mounted on the frame of the body, and the first and the second guide portions are secured on the cover to pivotally open and close the paper conveyance guide.

4. The image forming apparatus for duplex printing of claim 3, wherein the body comprises a driving motor generating a driving power, and the reverse conveying roller assembly comprises:

a reverse conveying roller disposed on the second surface of the paper conveyance guide, and having a shaft and a fixing member rotatably fixing the reverse conveying roller to the paper conveyance guide;

a tension roller disposed on the second guide portion of the auxiliary conveyance guide to be in contact with the reverse conveying roller with a predetermined pressure; and a gear part disposed on one end of the shaft of the reverse conveying roller to transmit the driving force from the driving motor to the reverse conveying roller.

5. The image forming apparatus for duplex printing of claim 3, wherein the body comprises a driving motor generating a driving power, and the reverse conveying roller assembly comprises, two reverse conveying rollers formed on the second surface of the paper conveyance guide and spaced-apart at a predetermined distance from each other, and each having a shaft and a fixing member rotatably fixing the reverse conveying rollers to the page conveyance guide;

two tension rollers formed on the second guide portion of the auxiliary conveyance guide to be in engagement with the corresponding reverse conveying rollers with a predetermined pressure;

gear parts each disposed at an end of the shaft of corresponding reverse conveying rollers to transmit the driving force from the driving motor to the corresponding reverse conveying rollers; and an idle gear assembly formed between the gear parts of the shafts of the two reverse conveying rollers to transmit the driving force in a uniform direction from one reverse conveying roller to the other reverse conveying roller.

6. The image forming apparatus for duplex printing of claim 5, wherein the idle gear assembly comprises, a first idle gear rotatably supported on the first boss secured on the paper conveyance guide in an engagement with the gear part of the shaft of one reverse conveying roller, and having a first washer integrally formed thereon, a second idle gear rotatably supported on the second boss secured on the paper conveyance guide in an engagement with the first idle gear, and having a second washer integrally formed thereon, and a third idle gear rotatably supported on the third boss secured on the paper conveyance guide in an engagement with the second idle gear and the gear part of the shaft of the other reverse conveying roller, and having a washer integrally formed thereon; and the first, the second and the third idle gears are arranged on the first, the second and the third bosses, respectively, in a manner such that the washers thereof are positioned in an alternate arrangement, to enable one of the idle gears to be rotatably secured on the corresponding boss without securing all the idle gears on the corresponding bosses.

7. The image forming apparatus for duplex printing of claim 6, wherein each of the reverse conveying rollers comprises:

a plastic shaft having a gear part integrally formed thereon as the shaft; and a roller part of a tubular shape to be fit with the shaft.

8. The image forming apparatus for duplex printing of claim 7, wherein the fixing member, comprises:

a hole formed on the paper conveyance guide; and a shaft bushing having a hook formed at one end to be securely inserted in the hole; and a C-shape opening formed in the other end to be securely receiving the shaft of the reverse conveying roller.

9. The image forming apparatus for duplex printing of claim 8, wherein the duplex printing unit comprises:

a paper side guiding portion disposed on the second surface of the paper conveyance guide to guide an edge of the paper sheet during a paper conveyance by the reverse conveying roller assembly to prevent a paper skew.

10. The image forming apparatus for duplex printing of claim 9, wherein the side guiding portion comprises a rail portion formed on one end and having a flattened U-shape to guide the edge of the paper sheet and a fixing portion formed on the other end to fix the side guide portion to the second surface of the paper conveyance guide.

11. The image forming apparatus for duplex printing of claim 10, wherein the paper conveying portion comprises:

a conveying roller of a diameter disposed on the paper conveyance guide in a point where the first paper conveyance path and the second paper conveyance path join;

a first backup roller disposed on the frame of the body that defines the first paper conveyance path to be in contact with the conveying roller with a predetermined pressure to convey the paper sheet picked up by the pickup unit along the first paper conveyance path; and a second backup roller disposed on the third guide portion of the auxiliary conveyance guide to be in contact with the conveying roller with a predetermined pressure to convey the paper sheet being conveyed through the reverse conveying roller to the first paper conveyance path.

12. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet, and having a plurality of protruding ribs formed in a paper passing direction and spaced-apart from each other to reduce friction between the first surface and the paper sheet; and a duplex printing unit forming a second paper conveyance path with a second surface of the paper conveyance guide to guide the paper sheet conveyed from the paper discharging unit back to the first paper conveyance path, wherein the paper conveyance guide comprises a ground portion formed on the first surface between the developing unit and the fixing unit.

13. The image forming apparatus of claim 12, wherein the paper conveyance guide comprises:

another protruding ribs formed on the second surface in the paper passing direction and spaced-apart from each other to reduce the friction between the second surface and the paper sheet.

14. The image forming apparatus of claim 12, wherein the paper conveyance guide comprises a transfer roller rotatably disposed on the first surface to feed the paper sheet in the paper passing direction with the developing unit during developing the toner image on the paper sheet, and the protruding ribs are disposed between the pickup unit and the transfer roller.

15. The image forming apparatus of claim 14, wherein the protruding ribs are disposed between the transfer roller and the fixing roller.

16. The image forming apparatus of claim 12, wherein the frame comprises:

another protruding ribs formed on the portion of the frame in the paper passing direction and spaced-apart from each other to reduce the friction between the portion and the paper sheet.

17. The image forming apparatus of claim 12, wherein the portion of the frame comprises a front portion disposed between the pickup unit and the developing unit and a rear portion disposed between the developing unit and the fixing unit, and the frame comprises:

front protruding ribs formed on the front portion of the frame in the paper passing direction and spaced-apart from each other to reduce the friction between the front portion and the paper sheet.

18. The image forming apparatus of claim 17, wherein the frame comprises:

rear protruding ribs formed on the rear portion of the frame in the paper passing direction and spaced-apart from each other to reduce the friction between the rear portion and the paper sheet.

19. The image forming apparatus of claim 12, wherein the paper conveyance guide comprises:

a third surface formed between the first and second surfaces to guide the paper sheet from the second paper conveyance path to the first paper conveyance path; and another protruding ribs formed on the third surface of the paper conveyance guide in the paper passing direction and spaced-apart from each other to reduce the friction between the third surface and the paper sheet.

20. The image forming apparatus of claim 19, wherein the another protruding ribs are curved.

21. The image forming apparatus of claim 12, wherein the first paper conveyance path has a width in a direction perpendicular to the paper passing direction, and the protruding ribs are disposed through the width of the first paper conveyance path in the perpendicular direction.

22. The image forming apparatus of claim 12, wherein the paper conveyance guide comprises:

side and bottom walls formed on the first surface to define an accommodating portion;

a hole formed on the side wall;

a holder disposed in the accommodating portion and having a hook corresponding to the side wall;

a supporter movably disposed in the holder;

a spring disposed between the supporter and the holder; and a transfer roller having a shaft rotatably coupled to the supporter to be disposed on the first surface to feed the paper sheet in the paper passing direction with the developing unit during developing the toner image on the paper sheet.

23. The image forming apparatus of claim 12, wherein the paper conveyance guide comprises:

a base portion from which the protruding ribs protrude.

24. The image forming apparatus of claim 23, wherein the paper conveyance guide comprises:

a first area corresponding to a top surface of the protruding ribs to contact the paper sheet passing through the first paper conveyance path; and a second area corresponding to the base portion not contacting the paper sheet passing through the first paper conveyance path.

25. The image forming apparatus of claim 24, wherein the first area is less than the second area to reduce the friction between the first surface and the paper sheet during forming the toner image on the paper sheet.

26. The image forming apparatus of claim 12, wherein the duplex printing unit comprises:

an hinge rotatably mounted on the frame to open and close the second paper conveyance path.

27. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet, and having a plurality of protruding ribs formed in a paper passing direction and spaced-apart from each other to reduce friction between the first surface and the paper sheet; and a duplex printing unit forming a second paper conveyance path with a second surface of the paper conveyance guide to guide the paper sheet conveyed from the paper discharging unit back to the first paper conveyance path, wherein the paper conveyance guide comprises a conveying roller rotatably mounted on the paper conveyance guide, and having a roller surface disposed between the first surface and the second surface to feed the paper sheet from the second paper conveyance path to the first paper conveyance path.

28. The image forming apparatus of claim 27, wherein the roller surface comprises:

a first end disposed adjacent to an exit of the second paper conveyance path; and a second end disposed adjacent to an entrance of the first paper conveyance path.

29. The image forming apparatus of claim 28, wherein the another protruding ribs have a curved surface corresponding to the roller surface.

30. The image forming apparatus of claim 27, wherein the roller surface comprises:

a curved portion disposed between the first end and the second end.

31. The image forming apparatus of claim 27, wherein the frame comprises:

another portion corresponding to the roller surface of the conveying roller; and another protruding ribs formed on the another portion of the frame in the paper passing direction and spaced-apart from each other to reduce the friction between the another portion and the paper sheet.

32. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet, and having a plurality of protruding ribs formed in a paper passing direction and spaced-apart from each other to reduce friction between the first surface and the paper sheet; and a duplex printing unit forming a second paper conveyance path with a second surface of the paper conveyance guide to guide the paper sheet conveyed from the paper discharging unit back to the first paper conveyance path, wherein the paper conveyance guide comprises a ground portion formed on the first surface between the pickup unit and the developing unit.

33. The image forming apparatus of claim 32, wherein:

the first surface comprises, an indent wall defining an accommodating recess, and a hook formed on the indent wall; and the ground portion comprises, a first side disposed on the first surface, a second side disposed in the accommodating recess, and a hole formed on the second side to correspond to the hook of the first surface to secure the ground portion to the first surface.

34. The image forming apparatus of claim 32, wherein:

the first surface comprises, a first wall facing the first paper conveyance path, a side wall extended from the first wall toward an inside of the paper conveyance guide, a first hole formed on the first wall, and a second hole formed on the second wall; and the ground portion comprises, a first side covering the first wall to contact the paper sheet passing through the first paper conveyance path along the paper passing direction, a second side corresponding to the side wall, a first hook formed on the first side to be inserted into the first hole, and a second hook formed on the second side wall to be inserted into the second hole to secure the ground portion to the first surface.

35. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet, and having a plurality of protruding ribs formed in a paper passing direction and spaced-apart from each other to reduce friction between the first surface and the paper sheet; and a duplex printing unit forming a second paper conveyance path with a second surface of the paper conveyance guide to guide the paper sheet conveyed from the paper discharging unit back to the first paper conveyance path, wherein the paper conveyance guide comprises:

a transfer roller rotatably disposed on the first surface to feed the paper sheet in the paper passing direction with the developing unit during developing the toner image on the paper sheet;

a front ground portion disposed on the first surface between the transfer roller and the pickup unit; and a rear ground portion disposed on the first surface between the transfer roller and the fixing roller to be parallel to a rotational axis of the transfer roller.

36. The image forming apparatus of claim 35, wherein the front and rear ground portions are disposed to be parallel to a rotational axis of the transfer roller.

37. The image forming apparatus of claim 35, wherein the front and rear ground portions are disposed in a widthwise direction of the transfer roller.

38. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet, and having a plurality of protruding ribs formed in a paper passing direction and spaced-apart from each other to reduce friction between the first surface and the paper sheet; and a duplex printing unit forming a second paper conveyance path with a second surface of the paper conveyance guide to guide the paper sheet conveyed from the paper discharging unit back to the first paper conveyance path, wherein the duplex printing unit comprises:

first and second reverse conveying rollers conveying the paper sheet passing through the second paper conveyance path; and an idle gear assembly transferring a rotation force between the first and second reverse conveying rollers.

39. The image forming apparatus of claim 38, wherein:

the paper conveyance guide comprises, first and second holes formed on the second surface; and the duplex printing unit comprises:

first and second connectors having a hook corresponding to the respective first and second holes to couple the connectors to the second surface of the paper conveyance guide, and having first and second shaft bushings receiving the corresponding first and second reverse conveying rollers.

40. The image forming apparatus of claim 38, wherein the idle gear assembly comprises:

a plurality of bosses formed on the frame; and a plurality of idle gears rotatably supported by the corresponding bosses and contacting respective ones of the first and second reverse conveying rollers.

41. The image forming apparatus of claim 40, wherein the idle gear assembly comprises a shaft fixing member coupled to one of the bosses to secure one of the idle gears to the one boss.

42. The image forming apparatus of claim 40, wherein the idle gears other than the one idle gear are secured to the corresponding bosses by the one idle gear.

43. The image forming apparatus of claim 42, wherein the idle gears other than the one idle gear are not secured by the shaft fixing member.

44. An image forming apparatus for duplex printing, comprising:

a frame;

a paper storing unit mounted on the frame and containing a paper sheet;

a pickup unit picking up the paper sheet;

a developing unit rotatably disposed on a portion of the frame to form a toner image on the paper sheet;

a fixing unit fixing the toner image formed on the paper sheet;

a paper discharging unit discharging the paper sheet after the fixing unit fixes the visible image on the paper sheet;

a paper conveyance guide having a first surface forming a first paper conveyance path with the portion of the frame developing unit to guide the paper from the pickup unit toward the fixing unit during forming the toner image on the paper sheet; and a duplex printing unit forming a second paper conveyance path with a second surface of the paper conveyance guide, to guide the paper sheet conveyed from the paper discharging unit back to the first paper conveyance path, having first and second reverse conveying rollers conveying the paper sheet conveyed from the paper discharging unit back to the first paper conveyance path, and having an idle gear assembly transferring a rotation force between the first and second reverse conveying rollers, wherein:

the idle gear assembly comprises, a plurality of bosses formed on the frame, a plurality of idle gears rotatably supported by corresponding ones of the bosses and disposed between the first and second reverse conveying rollers, and a shaft fixing member coupled to one of the bosses to secure one of the idle gears to a corresponding one of the bosses while the idle gears other than the one idle gear are secured to corresponding ones of the bosses by the one idle gear.

45. The image forming apparatus of claim 44, wherein the idle gears other than the one idle gear are not secured by the shaft fixing member.

* * * * *

UNITED STATES PATENT AND TRADEMARK OFFICE

CERTIFICATE OF CORRECTION

PATENT NO. : 6,987,525 B2
DATED : January 17, 2006
INVENTOR(S) : Dong-ha Choi

It is certified that error appears in the above-identified patent and that said Letters Patent is hereby corrected as shown below:

Column 20,
Line 58, replace “an hinge” with -- a hinge --.

Signed and Sealed this

Twenty-third Day of May, 2006

JON W. DUDAS
*Director of the United States Patent and Trademark Office*